United States Patent [19]

Sato

[11] Patent Number: 4,524,684

[45] Date of Patent: Jun. 25, 1985

[54] CONTINUOUS PRESS

[75] Inventor: Hachiro Sato, Tokyo, Japan

[73] Assignee: Fukoku Kogyo Co., Ltd., Tokyo, Japan

[21] Appl. No.: 526,149

[22] Filed: Aug. 24, 1983

[30] Foreign Application Priority Data

Sep. 10, 1982 [JP] Japan ..... 57-137592

[51] Int. Cl.[3] ..... B30B 9/16

[52] U.S. Cl. ..... 100/117; 100/147; 239/452

[58] Field of Search ..... 100/117, 146–149; 239/451, 452, 455; 366/321

[56] References Cited

U.S. PATENT DOCUMENTS

| | | | |
|---|---|---|---|
| 2,901,184 | 8/1959 | Kane | 239/452 |
| 3,224,739 | 12/1965 | Schuur | 366/321 X |
| 3,939,763 | 2/1976 | Sato | 100/117 X |
| 3,943,034 | 3/1976 | Wallén | 100/147 X |
| 4,256,033 | 3/1981 | Poznanovic | 100/147 X |
| 4,393,983 | 7/1983 | Eriksson | 100/148 X |

FOREIGN PATENT DOCUMENTS

| | | | |
|---|---|---|---|
| 592997 | 5/1959 | Italy | 100/147 |
| 163032 | 4/1958 | Sweden | 239/452 |

*Primary Examiner*—Peter Feldman

[57] ABSTRACT

In a continuous press of a screw blade type, a driving shaft is rotatably secured to a frame by means of thrust bearings at both ends of the driving shaft, a screw drum having an increasing diameter towards center is disposed around the driving shaft to rotate therewith, a pair of screw blades are helically arranged around the screw drum symmetrically with respect to the center of screw drum, and an outer drum having a number of small filtering holes is arranged around the screw blades. A pair of inlets for introducing raw materials to be pressed are provided at both ends of the outer drum and an outlet from which the pressed raw materials are discharged is also provided in the outer drum at its center. At the outlet a pair of cone-shaped plates are arranged movably in an axial direction of the press and these plates are resiliently pressed towards each other. The pressure applied to the cake is automatically maintained constant due to the axial movement of the plates.

10 Claims, 4 Drawing Figures

CONTINUOUS PRESS

BACKGROUND OF THE INVENTION

The present invention relates to a continuous press including a frame, a driving shaft journaled to the frame at its both ends by means of thrust bearings, a screw drum disposed around the driving shaft to rotate therewith, a screw blade arranged helically around the outer surface of the screw drum, an outer drum arranged around the screw blade and having a number of small filtering holes, an inlet provided in the outer drum for introducing raw materials into a space between the screw drum and outer drum and an outlet provided in the outer drum for discharging the pressed materials as a cake, whereby the space is gradually made smaller in a direction from said inlet to said outlet.

Such a continuous press has been known from, for example U.S. Pat. No. 3,939,763 and can be effectively utilized to press continuously water, oils and fats out of various kinds of raw materials. In the known continuous press, a removable lid member is provided at the outlet of the press for applying a pressure to raw material to adjust the amount of cake discharged from the outlet. However, in the known press, when the amount of cake is increased, the lid is easily opened to a larger extent and thus the lid does not move suitably to regulate the amount of cake. Therefore, it is rather difficult to adjust the pressure applied to the cake to a given constant value. In order to effect the desired pressing operation even under such a condition that the amount of the cake fluctuates largely, it is very important to keep the cake pressure constant. In the known continuous press, a repelling force generated by the pressing is applied to the screw shaft via the screw blade and screw drum and therefore, the thrust bearings are subjected to the very strong thrust force. This requires large and strong thrust bearings, so that the cost is increased. Further, the usuable duration of the thrust bearings becomes short and the bearings must be repaired often. Thus, in the known continuous press the maintenance is very combersome.

SUMMARY OF THE INVENTION

The present invention has for its object to provide a novel and useful continuous press of the kind mentioned in the preamble, in which the pressure applied to a cake can be maintained always to a given constant value under various conditions, by limiting an amount of movement of a lid member provided at an outlet of the press. It is another object of the invention to provide a continuous press, which needs only small thrust bearings without decreasing the efficiency of pressing.

According to the invention, a continuous press comprises a frame;

a driving shaft journaled to the frame at its both ends by means of thrust bearings;

a screw drum disposed around the driving shaft to rotate therewith;

first and second screw blades disposed around the outer surface of the screw drum;

an outer drum arranged around the screw blades and having a number of small filtering holes;

an inlet provided in said outer drum for introducing raw materials into a space formed by the screw drum, first and second screw blades and outer drum;

an outlet provided in said outer drum for discharging the pressed raw materials as a cake;

first and second disc-shaped plates arranged oposite to each other at the outlet for guiding the pressed cake outwardly in a radial direction of the outer drum;

means secured to the frame for supporting at least one of the plates movably in an axial direction of the press; and means secured to the frame for resiliently pressing said at least one of the plates towards each other; whereby the space is gradually made smaller from said inlet to said outlet.

DESCRIPTION OF THE PREFERRED EMBODIMENTS

Figure 1:
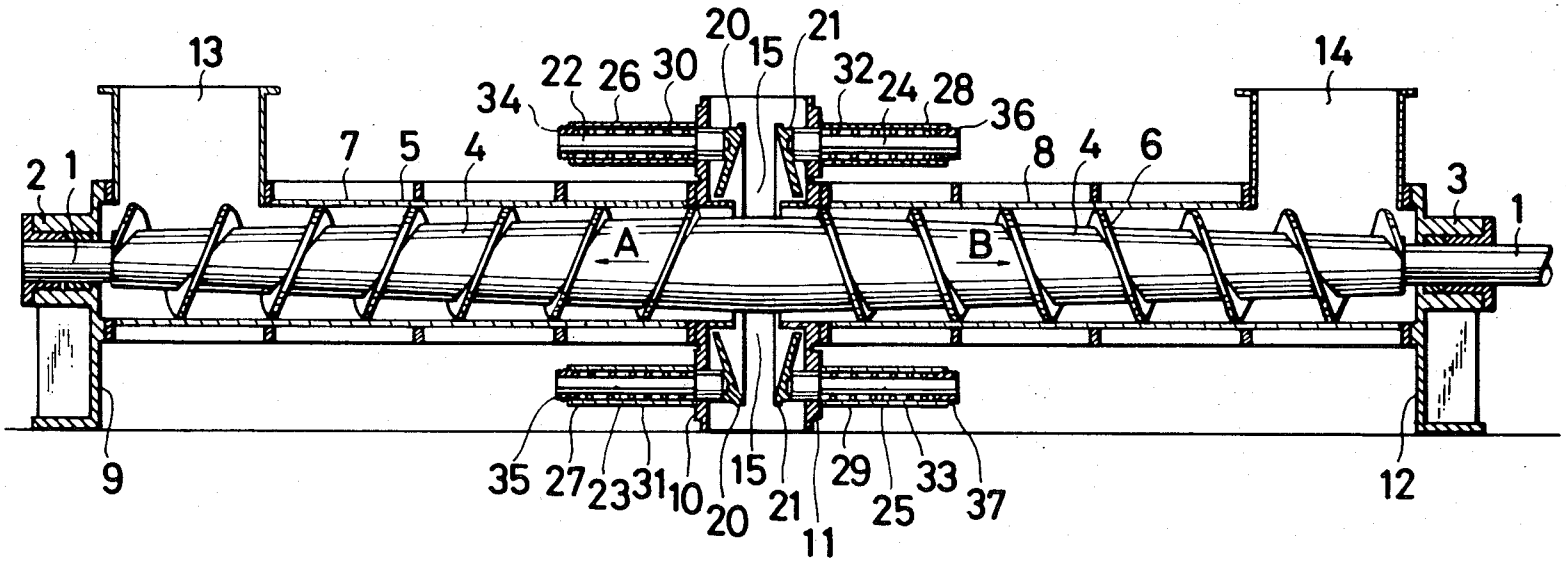
FIG. 1 is a cross section showing an embodiment of the continuous press according to the invention.

FIG. 1 shows an embodiment of the continuous press according to the invention. The press comprises a driving shaft 1 which is journaled at its both ends by thrust bearings 2 and 3 and is rotated by an electric motor not shown via a suitable mechanism. Around the driving shaft 1 is secured a screw drum 4 made of a metal drum which is so tapered that its diameter is gradually smaller towards both ends thereof. Around the outer surface of the screw drum 4 are arranged symmetrically a pair of screw blades 5 and 6. These screw blades have a constant pitch, but their twisting directions are opposit to each other. The outer diameter of the screw blades is uniform over their length. Around the screw blades are arranged outer drums 7 and 8 having a number of small filtering holes. Both ends of the outer drums 7 and 8 are secured to frame members 9, 10, 11 and 12. At outer extreme ends of the outer drums 7 and 8 are formed first and second inlets 13 and 14 from which raw materials to be pressed are supplied into the press. Further, a center outlet 15 is formed between the outer drums 7 and 8 through which a cake is discharged. The raw materials supplied from the inlets 13 and 14 are introduced into spaces formed by the screw drum 4, screw blades 5 and 6 and outer drums 7 and 8. These spaces are gradually decreased towards the center outlet 15. Therefore, the raw materials are transported towards the center outlet 15 by means of the rotating screw blades 5 and 6, and during this transportation, the raw materials are pressed to a gradually increasing extent.

In the present embodiment, at the outlet 15 between the outer drums 7 and 8, there are symmetrically arranged shallow cone-shaped plates 20 and 21 each having a large apex angle in such a manner that their outer peripheries having a larger diameter face each other. The diameter of the plates 20 and 21 are larger than that of the outer drums 7 and 8. To the cone-shaped plates 20 and 21 are secured supporting shafts 22, 23 and 24, 25, respectively which are then movably inserted into guide sleeves 26, 27 and 28, 29, respectively. The guide sleeves 26 and 27 are secured to the frame member 10 and the guide sleeves 28 and 29 are secured to the frame member 11. Thus, the cone-shaped plates 20 and 21 are movable in a direction of the driving shaft 1. In the guide sleeves 26, 27, 28 and 29 are inserted coiled springs 30, 31, 32 and 33, respectively so as to compress the supporting shafts 22, 23, 24 and 25, and thus the cone-shaped plates 20 and 21 towards the center of the press. At the outer ends of the guide sleeves 26, 27, 28 and 29 are threaded adjusting screws 34, 35, 36 and 37, respectively, so that the compressing force of the springs 30, 31, 32 and 33 is made adjustable by means of the screws 34, 35, 36 and 37. In this manner, the compressing force applied to the cake during the operation can be set to a desired value.

In the continuous press of the present embodiment, when the driving shaft 1 is rotated at a given speed, the screw drum 4 and thus the screw blades 5 and 6 are rotated in such a manner that the raw materials introduced from the first inlet 13 are transported rightwards, but the raw materials supplied from the second inlet 14 are transported leftwards. During the transportation, the raw materials are gradually pressed due to the decrease in the spaces towards the center of the press and liquid extruded out of the raw materials is discharged through the filtering holes formed in the outer drums 7 and 8 and is collected in a receptacle not show. Then the cakes are moved towards the center outlet 15.

During the operation of the continuous press, the raw materials are subjected to the compressing forces from the screw blades 5 and 6 towards the center. Then, to the screw drum 4 are applied, via the screw blades 5 and 6, repelling forces directing opposite to each other as shown by arrows A and B in the figure. Therefore, the repelling forces are cancelled by each other and theoretically no thrust force is applied to the bearings 2 and 3. Further, the outlet 15 is provided at the center of the press and the cone-shaped plates 20 and 21 which serve to apply the pressing force to the cakes are provided at the outlet 15, and therefore the compressing forces producing the maximum repelling forces at the outlet 15 are substantially equal to each other so that the repelling forces are cancelled by each other at the outlet 15. In fact, a small repelling force is applied to the driving shaft 1 due to fluctuation of the raw materials supplied from the inlets 13 and 14, but the maximum repelling forces produced at the center of the press become substantially equal to each other. Thus, according to the invention, the thrust bearings 2 and 3 can be made small and simple, while the stable operation of the press can be attained for a very long life time. Moreover, the maintenance and repair of the press can be made materially simple and easy.

At the center outlet 15, the cakes are pushed outwardly in a radial direction and are introduced into a space between the cone-shaped plates 20 and 21. In this space, the cakes are further compressed by the cone-shaped plates and are discharged therefrom. When the cake pressure becomes higher than the pressure due to the springs 30 to 33, the cone-shaped plates 20 and 21 are moved outwardly against the spring force and then the cake pressure becomes a smaller. In this manner, the cake pressure can be adjusted at will by means of the adjusting screws 34 to 37, so that the position in the press at which the raw materials are filled can be adjusted.

Figure 2:
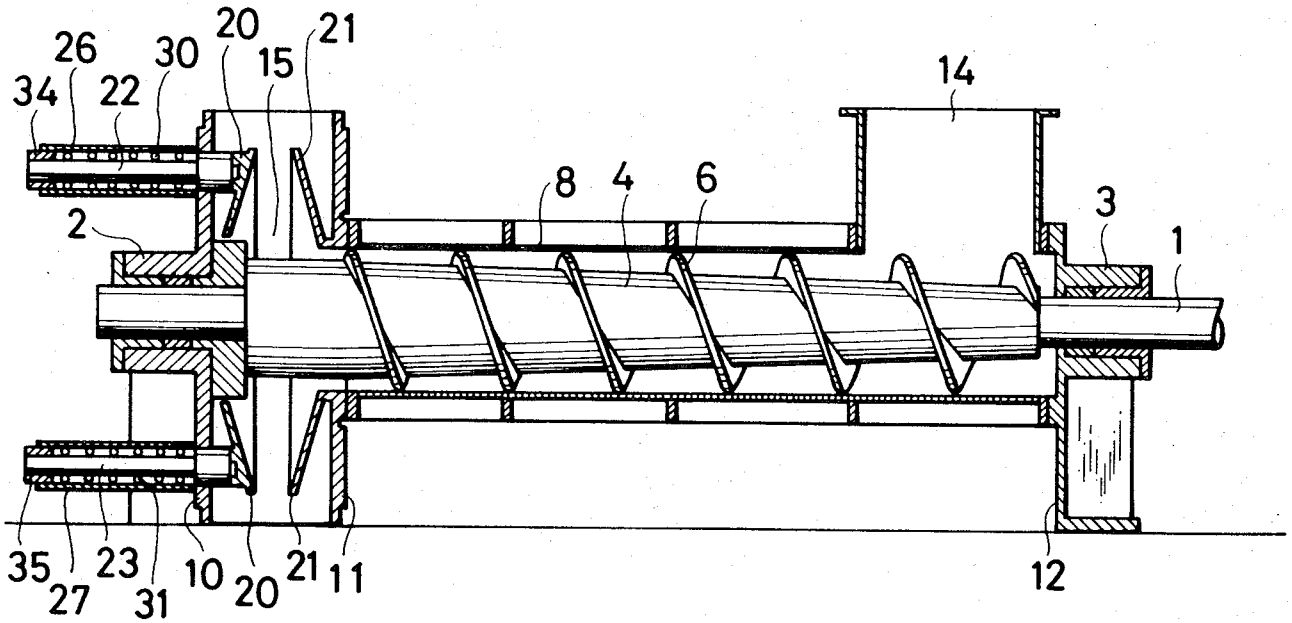
FIG. 2 is a cross section illustrating another embodiment of the continuous press according to the invention.

FIG. 2 shows another embodiment of the press according to the invention, in which portions similar to those shown in FIG. 1 are denoted by the same reference numerals used in FIG. 1. In the present embodiment, only one of the cone-shaped plates 20 is arranged movably, and the other plate 21 is provided fixedly. As illustrated in FIG. 2 the plate 21 is secured to the frame member 11. Moreover, in the present embodiment, there is formed a single pressing space constituted by the rotating drum 4, screw blade 6 and outer drum 8. The remaining construction is entirely same as the previous embodiment. Also in the present embodiment, since the plate 20 is arranged movably, the pressure applied to the cake in pressing space can be maintained constant, so that the cake can be always pressed effectively even if the amount of the cake fluctuates to a great extent.

Figure 3:
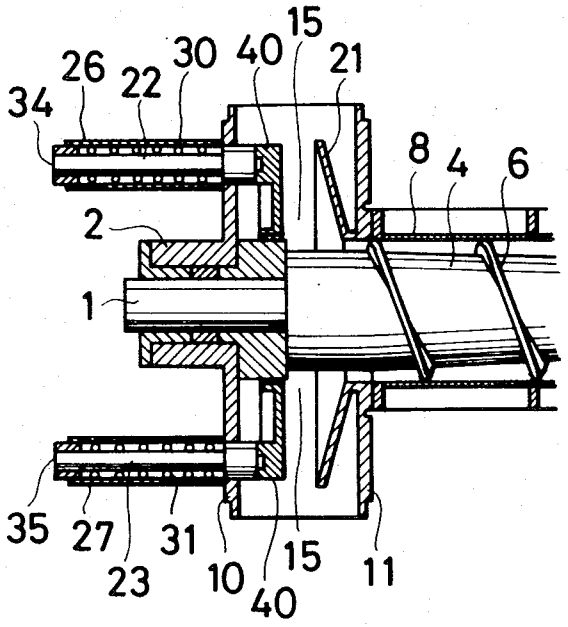
FIG. 3 is a cross section depicting still another embodiment of the continuous press according to the invention.

FIG. 3 is a cross section illustrating another embodiment of the press according to the present invention. It the present embodiment, the plate 21 is also fixed to the frame member 11 and a plate 40 consisting of a flat disc is movably arranged. The mechanism for moving the plate 40 is same as that of the previous embodiments. Also in the present embodiment, since the plate 40 is moved in the axial direction, the cake pressure can be kept constant under various conditions.

Figure 4:
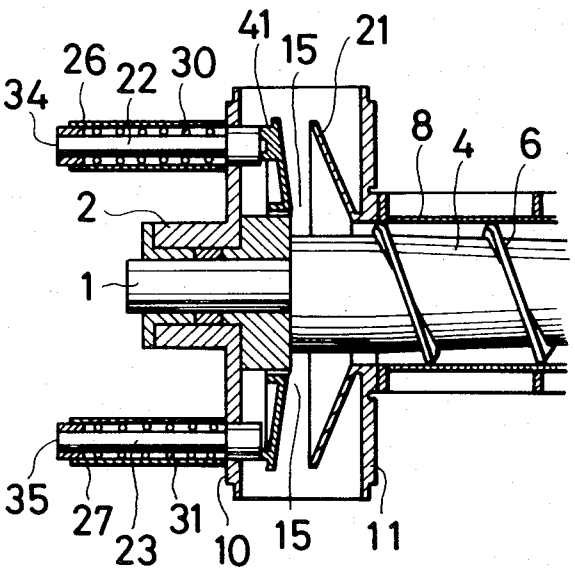
FIG. 4 is a cross section of still another embodiment of the press according to the invention.

FIG. 4 is a cross section showing still another embodiment of the continuous press according to the present invention. In the present embodiment, the cone-shaped plate 21 is secured to the frame member 11 and a wedge-like plate 41 is arranged movably to the frame member 10. In the present embodiment, the pressure applied to the cake is also regurated suitably by means of the two plates 21 and 41 and thus the desired pressing operation is effected even though the amount of the material in the pressing space is varied.

The present invention is not limited to the embodiments explained above, but many modifications and alternations can be concieved within the scope of the invention. For instance, in the embodiments the screw drum 4 is formed by a tapered drum and the screw blades 4 and 5 have the constant pitch, but the screw drum may be formed by a drum having a constant diameter over its whole length and the screw blades may have a varying pitch decreasing towards the outlet. Further in the above embodiments, the plates are moved in the axial direction by means of the spring force, but they may be moved by means of the oil pressure.

As explained above in detail, according to the present invention, since the plate or plates arranged at the outlet of the press are moved by the cake extracted from the outlet, the pressure applied to the cake is automatically adjusted to a desired value and pressing operation is always effected optimally. Moreover, the circumferential length of the cake outlet is increased by the plates as compared with the known press, and thus the movement of the plates due to the fluctuation of the cake is limited to a large extent, so that the cake pressure is maintained constant effectively. Further, the actual outlet of the press is extended outwardly in the radial direction of the press, and therefore the operating area of the plates becomes large and the pressure applied to the plates can be controlled precisely. It should be further noted that since even a small displacement of the plates results in a large variation in a volume of the output space formed between the plates, a large fluctuation of the cake amount can be easily compensated for and the cake pressure can be maintained constant stably. Further, in the continuous press shown in FIG. 1, at the central outlet where the maximum force is applied to the screw blades, the cakes are joined with each other and the repelling forces applied to both the screw blades balance, so that the thrust force applied to the driving shaft becomes very small. Therefore, the thrust bearings for journaling the driving shaft can be made much simpler and yet the usable duration of the press can be materially prolonged. Moreover, at the outlet the cakes are compressed with each other to increase the internal pressure of the cakes and thus the pressing or compressing efficiency becomes higher.

What is claimed is:

1. A continuous press comprising:

a frame;

a driving shaft journaled to the frame at its both ends by means of thrust bearings;

a screw drum disposed around the driving shaft to rotate therewith;

first and second screw blades disposed around the outer surface of said screw drum;

an outer drum arranged around the screw blades and having a number of small filtering holes;

an inlet provided in said outer drum for introducing raw materials into a space formed by the screw drum, first and second screw blades and outer drum;

an outlet provided in said outer drum for discharging the pressed raw materials as a cake;

first and second ring-shaped plates arranged opposite to each other at the outlet, an inner diameter of the ring-shaped plates being larger than that of the outlet of the outer drum so that the pressed cake is urged against only an inner surface of the plates and is guided outwardly in a radial direction of the outer drum;

means secured to the frame for supporting at least one of the plates movably in an axial direction of the press; and means secured to the frame for resiliently pressing said at least one of the plates towards each other; whereby said space is gradually made smaller than said inlet to said outlet.

2. A continuous press according to claim 1, wherein both of said first and second ring-shaped plates are arranged movably in the axial direction.

3. A continuous press according to claim 1, wherein said first ring-shaped plate is arranged movably and said second ring-shaped plate is fixed to the frame.

4. A continuous press according to claim 4, wherein said pressing means comprises coiled springs for pressing at least one of the first and second ring-shaped plates towards each other and adjusting members for adjusting spring forces of the coiled springs.

5. A continuous press according to claim 1, wherein at least one of the first and second ring-shaped plates is formed by a cone-shaped plates having a large apex angle.

6. A continuous press according to claim 1, wherein at least one of said first and second ring-shaped plates is formed by a flat disc-shaped plate.

7. A continuous press according to claim 1, wherein at least one of said first and second ring-shaped plates is formed by a wedge-like plate.

8. A continuous press according to claim 1, wherein said screw drum has a varying diameter which is gradually larger towards the outlet and said screw blade has a constant pitch.

9. A continuous press according to claim 1, wherein said screw drum has a constant diameter over its whole length and said screw blade has a varying pitch which is gradually smaller towards the outlet.

10. A continuous press according to claim 1, wherein first and second screw blades are symmetrically disposed around the outer surface of the screw drum, twisting directions of these screw blades being opposite to each other, first and second inlets are provided at both ends of the outer drum, and the outlet is provided at the center of the outer drum.

* * * * *